US005220988A

United States Patent [19]

Wilfong et al.

[11] Patent Number: 5,220,988

[45] Date of Patent: Jun. 22, 1993

[54] COIN SLIDE WITH MAGNETIC SLUG ATTRACTING MEANS

[75] Inventors: Evan C. Wilfong, Philadelphia; Harvey S. Gitlin, Ambler; John J. Duffy, Glenside, all of Pa.

[73] Assignee: Equipment Systems & Devices, Inc., Ambler, Pa.

[21] Appl. No.: 527,088

[22] Filed: May 22, 1990

[51] Int. Cl.[5] ..... G07D 5/08; G07F 5/04

[52] U.S. Cl. ..... 194/235; 194/238; 194/325

[58] Field of Search ..... 194/235, 238, 320, 321, 194/322, 323, 324, 325

[56] References Cited

U.S. PATENT DOCUMENTS

| | | | |
|---|---|---|---|
| 3,602,352 | 8/1971 | Robinson | 194/238 |
| 3,732,962 | 5/1973 | Hall | 194/238 |
| 3,978,960 | 9/1976 | Mellinger et al. | 194/235 |
| 4,350,240 | 9/1982 | Gitlin et al. | 194/234 |
| 4,401,202 | 8/1983 | Gitlin et al. | 194/235 X |
| 4,499,983 | 2/1985 | Gitlin et al. | 194/229 X |
| 5,027,936 | 7/1991 | Boyett | 194/238 X |

*Primary Examiner*—F. J. Bartuska

*Attorney, Agent, or Firm*—Eckert, Seamans, Cherin & Mellott

[57] ABSTRACT

A coin slide with attracting magnets is disclosed which incorporates a coin slide body with integral mounting flange, a keeper secured rearwardly of the mounting flange to position a plurality of magnets in vertical, side-by-side relationship, the magnets defining coin checking paths therebetween, a bridge secured to the body rearwardly of the mounting flange whereby the forward edge of the bridge and the rearward surface of the mounting flange define a clearance space therebetween, the magnets being positioned in the clearance space to detect any ferrous slugs as they pass through the magnet defined coin checking paths, the magnets lifting the slug sufficiently to cause the slug to jam against the forward edge of the bridge and not to pass through the bridge.

16 Claims, 2 Drawing Sheets

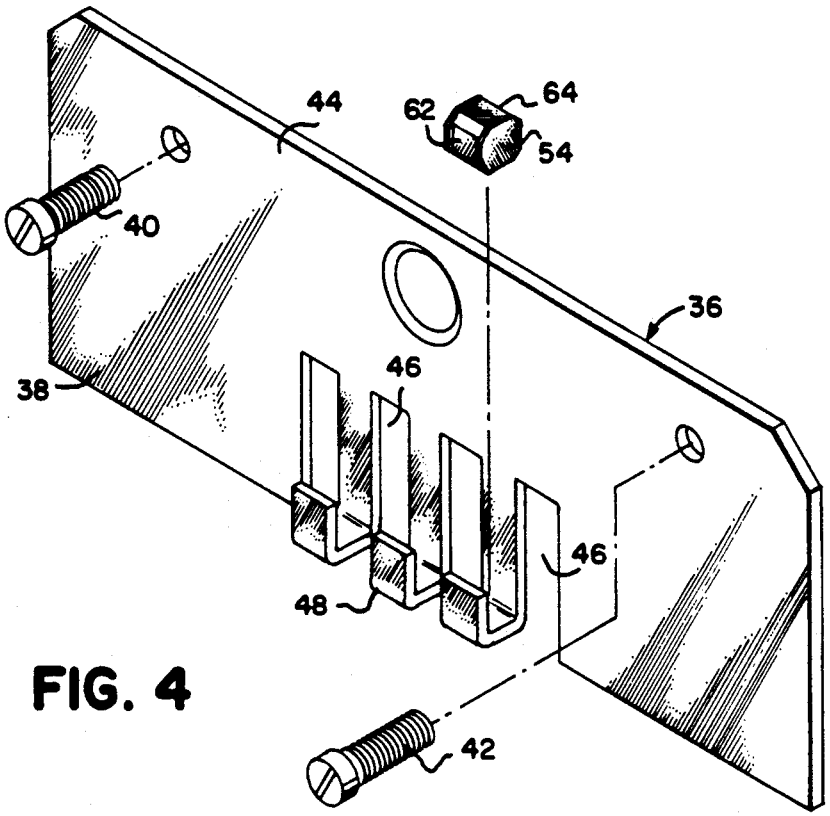
FIG. 4
FIG. 1
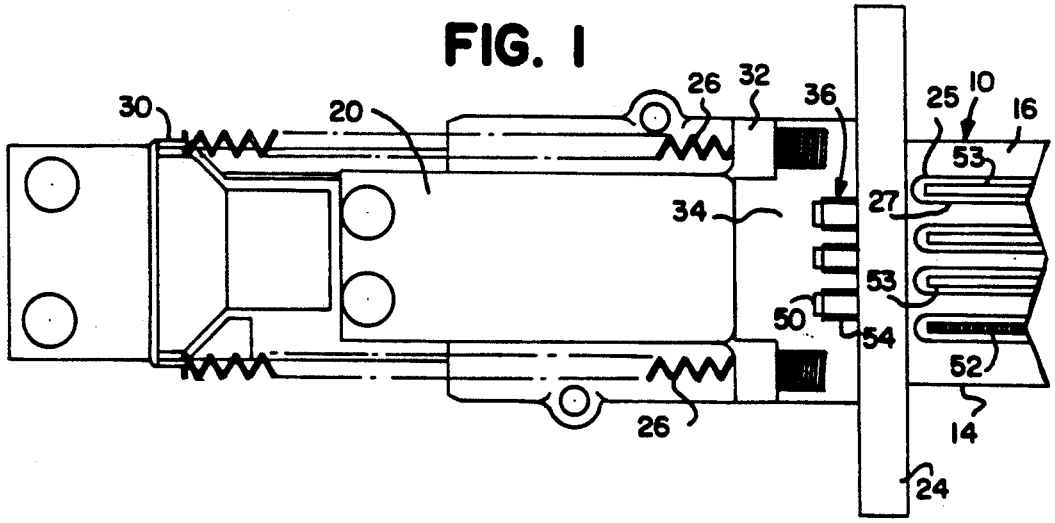

COIN SLIDE WITH MAGNETIC SLUG ATTRACTING MEANS

BACKGROUND OF THE INVENTION

1. Field of the Invention

The present invention relates generally to the field of coin accepting mechanisms for use in the vending machine industry, and more particularly, is directed to an improved coin slide capable of accepting and processing a plurality of coins in vertical, transversely spaced alignment and which includes magnetic means to detect and reject ferrous slugs.

2. Discussion of the Prior Art

Coin slides have long been utilized in the vending machine industry to function various types of vending machines upon the introduction of the correct number and denomination of coins. The prior art coin slides have been designed to receive and check the proper number and denomination of coins and to initiate the function of the vending machine in response to the introduction of the coins. More recently, vertical type coin slides have become increasingly popular in view of their compactness, their reliability and their capability of handling larger numbers of coins. Further, changes in the vending price in such vertical coin slides can be made without requiring special skills or specially constructed tools.

As set forth in U.S. Pat. Nos. 4,350,240, 4,401,202 and 4,499,983, which patents are owned by the assignee of the present application, improved features have been designed to render the vertical type coin slides capable of rapid and easy price adjustment. This feature allows vending machine operators to adjust the coin slides of large numbers of machines as necessary to either increase the vending price or to lower the vending price, in accordance with day-to-day market place requirements. Interchangeable cores have been designed in the devices of the said prior patents for storage of suitable parts directly within the coin slides in a manner which enables an operator to adjust the vending price without requiring major disassembly of the component parts of the coin slide. Other improvements have been designed to increase the resistance of vertical coin slides to theft and to breakage.

While the devices of U.S. Pat. Nos. 4,350,240, 4,401,202 and 4,499,983 additionally have incorporated many improved construction features which were particularly designed to minimize the acceptance of bad coins and to discourage tampering, experience has proven that even such improved coin slides could sometimes be manipulated in a manner to function the associated machine by employing rather crudely made slugs. This was possible so long as the slugs conformed generally to the weight and dimensional characteristics of an authentic coin. The present invention incorporates additional construction features to prevent the function of the coin slide and consequently the associated vending machine when ferrous slugs are attempted to be substituted for proper coins.

SUMMARY OF THE INVENTION

The present invention relates generally to the field of coin slides suitable for use with coin operated vending machines, and more particularly, is directed to an improved coin slide of the vertical type which features magnetic means to prevent function of the machines when ferrous slugs are inserted.

The coin slide of the present invention comprises a body having a conventional, integral flange for securely mounting the coin slide in a vending machine in well known manner. An integral handle and slide plate is longitudinally movable relative to the body in the usual manner and is provided with a plurality of elongated slots for selectively receiving therein any one of a plurality of interchangeable coin receiving cores. The interchangeable cores each include sized coin receiving slots and are mounted in a manner to enable an operator to change the vending price without major coin slide disassembly. Optionally, the core could be constructed as a blank which is intended to properly function without the presence of a coin.

The interchangeable cores receive coins of predetermined denomination and in combination, therein make up the predetermined vend price. When the required number and denomination of coins are properly positioned in the coin slots in the interchangeable cores, an initial coin size check is therein made. The coin slide may then be rearwardly pushed in known manner and the coins will pass through coin receiving and checking grooves in the slide mounting flange whereat a second coin size check will be made.

A plurality of laterally spaced, small, extremely powerful magnets are mounted and positioned immediately rearwardly of the coin receiving grooves in the slide mounting flange whereby each coin must pass adjacent to a polarized face of a magnet as the slide is initially rearwardly urged. It is a feature of this invention to arrange the north and south poles of each magnet in a vertical plane in opposed faces of each magnet whereby coins introduced into the coin slide will pass immediately in front of a north or of a south pole of one of the magnets as the coin slide is rearwardly pushed.

As shown in U.S. Pat. Nos. 4,350,240 and 4,401,202, a bridge is provided rearwardly of the slide mounting flange in position to be contacted by the vertically oriented coins after they pass through the grooves in the slide mounting flange for additional coin checking and receiving purposes. It is a feature of this invention to position the magnets at a elevation above the center line of the coins as they reside in the coin receiving slots in the cores. Should ferrous slugs of proper size be placed in coin receiving slots of one or more of the cores in lieu of an authentic coin or coins, the magnets will attract the slug and urge each slug upwardly out of its coin receiving slot. This elevation of the slug will cause a portion of the slug outer periphery to abut and jam against the forward edge of the bridge whereby it will then be impossible for the slug to pass through and beneath the bridge as the handle and slide plate are rearwardly urged.

This then jams the mechanism and will prevent any further rearward movement of the slide plate. The magnets consequently serve to absolutely prevent activation of the vending machine when ferrous slugs are attempted to be used. By providing magnets immediately adjacent to each coin receiving groove in the slide mounting flange, any ferrous metal slug that may be present in the coin slide will be attracted and lifted out of its respective coin receiving slot as the slide plate carries the interchangeable cores rearwardly past the slide mounting flange. The attraction between a magnet and a slug is designed to be so great as to absolutely prevent the slug from passing rearwardly through and below the bridge for subsequent activation of the vending machine.

It is therefore an object of the present invention to provide an improved coin slide with magnetic slug attracting means of the type set forth.

It is another object of the present invention to provide a novel coin slide with magnetic slug attracting means which comprises a plurality of small, powerful magnets mounting rearwardly of the slide mounting flange adjacent to each coin receiving groove in the slide mounting flange to check and attract any ferrous metal slug that may have been positioned in a coin receiving slot.

It is another object of the present invention to provide a novel coin slide with magnetic slug attracting means which comprises a plurality of small, powerful magnets mounting in side-by-side relationship immediately rearwardly of the slide mounting flange and forwardly of the bridge, the magnets being positioned in laterally spaced relationship whereby the north pole of one magnet faces the south pole of its immediately adjacent magnet.

It is another object of the present invention to provide a novel coin slide with magnetic attracting means that is simple in construction, tamper-proof when installed and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a partial, top plan view of a coin slide constructed in accordance with the teachings of the present invention, and showing the coin slide in the coin accepting position.

FIG. 4 is an enlarged perspective view of the magnet keeper with one of the magnets illustrated in exploded relationship.

DESCRIPTION OF THE PREFERRED EMBODIMENT OF THE INVENTION

Figure 2:
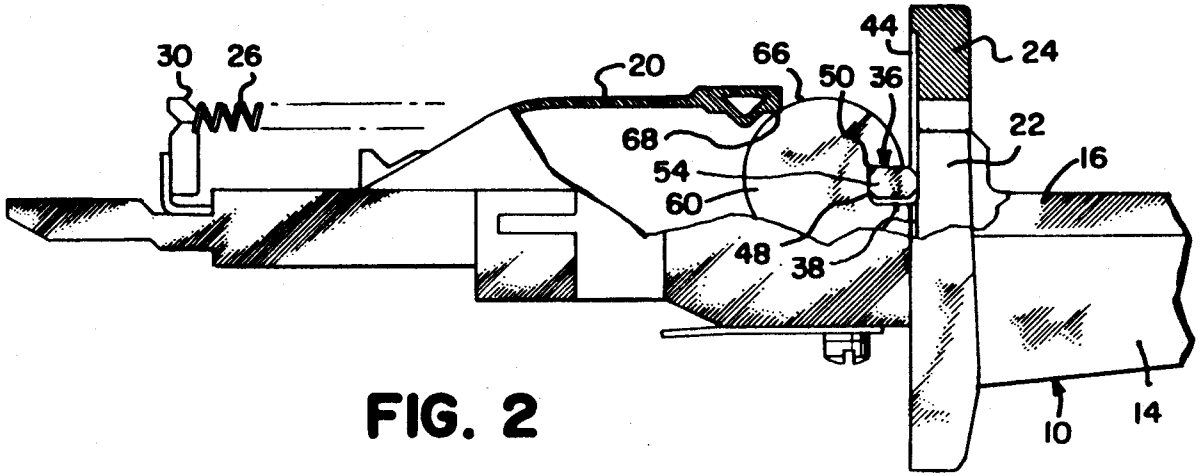
FIG. 2 is a side elevational view of the coin slide of FIG. 1, partially broken away to expose interior construction details and showing a ferrous slug attracted by a magnet.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIG. 1, a coin slide 10 which is designed and adapted to receive coins 52 in vertical orientation and which is suitable for initiating the vending cycle in numerous types of vending machines, for example, washing machines and drying machines of the type generally installed in coin operated laundries, apartment buildings and the like.

The coin slide 10 comprises generally a sturdy, metallic body 14 which includes an integral, slide mounting flange 24 of usual design for securing the coin slide 10 to the front panel (not shown) of a vending machine in usual manner. An operating slide plate 16 is movable longitudinally of the body 14 for vending machine operation purposes upon the insertion of the correct number and denomination of coins. The slide plate 16 terminates forwardly in a conventional operating handle of suitable shape to facilitate rearward movement of the slide plate 16 relative to the body 14 to initiate the vending process upon the insertion of coins of the correct number and size.

Still referring to FIG. 1 and as illustrated in FIG. 2, it will be observed that the mounting flange 24 is machined, diecast, molded or otherwise formed to provide a plurality of coin receiving grooves 22 in longitudinal alignment with the central axis of the respective core openings 25 which are provided in the slide plate 16 to respectively receive the plurality of interchangeable cores 27. By precisely sizing the coin receiving grooves 22, an important coin checking function can be easily and conveniently built into the coin slide 10 in known manner. So long as a coin 52 can insert within a coin receiving opening or slot 53 provided in an interchangeable core 27 and then pass through a coin receiving groove 22 in the slide mounting flange 24, the coin will have automatically been subjected to two size checks and there will be no resistance to further rearward movement of the slide plate 16 toward initiation of the vending cycle.

In known manner, a pair of operating springs 26 bias between respective lugs 30 which are rearwardly affixed on the slide plate 16 and stationary portions 32 of a coin bridge 20. The springs 26 normally bias the slide plate 16 to an initial, forward, coin accepting position as illustrated in FIG. 1. When the slide plate 16 is urged rearwardly upon insertion of a correct plurality of coins 52 within the coin slots or openings 53 provided in the interchangeable cores 27, the bias of the springs 26 will be overcome by rearwardly directed forces on the handle as applied by the hand of the user (not shown) in known manner.

After the correct number and denomination of coins have been inserted into the coin slots or openings 53 of the interchangeable cores 27, the slide plate 16 can be pushed rearwardly to urge the coins 52 rearwardly of the slide mounting flange 24 through the coin receiving grooves 22 therein and toward the bridge 20. The bridge 20 is provided rearwardly of the slide mounting flange 24, as explained in the previous patents of the present inventors, for additional coin checking function and for urging the coins downwardly into contact respectively with a plurality of spring biased levers (not shown).

It is a feature of this invention to undercut forward portions of the bridge 20 to define an additional clearance space 34 between the forward face of the bridge and the rearward face of the slide mounting flange 24. The additional clearance space 34 thereby provided permits the insertion of the new magnetic coin checking means 36 therein, as hereinafter more fully set forth.

As illustrated, a segmented metallic keeper 38 is rearwardly affixed to the slide mounting flange 24 by employing threaded or other fasteners 40, 42 which can be applied through suitable openings provided in the upper body 44 of the metallic keeper 38 and into cooperating openings provided in the flange 24 in well known manner. As illustrated, the upper body 44 of the magnetic keeper 38 terminates downwardly in a plurality of depending fingers 48, which fingers define a plurality of vertical coin checking paths 46 therebetween. The coin checking paths 46 are machined, stamped or otherwise positioned in the keeper 38 to exactly align with the coin receiving grooves 22 in the slide mounting flange 24. Accordingly, any coins of proper size and denomination that can pass through the coin receiving grooves 22 in the slide mounting flange will also pass through the plurality of vertical coin checking paths 46 in the metallic keeper 38 without interference.

In a preferred construction, the depending fingers 48 are each downwardly formed into a substantial U-shaped bend to define a plurality of lower, bent magnet retainers 50. As shown, each bent retainer 50 receives and secures a small, extremely strong, permanent magnet 54 therewithin for slug attracting purposes as hereinafter more fully set forth. The magnets 54 should be sufficiently strong to attract and lift any ferrous slug 60 that may have been initially positioned either intentionally or unintentionally in one of the coin slots or openings 53 of an interchangeable core 27. Suitable magnets for this purpose may be precisely dimensioned small magnets as manufactured and sold by General Electric Company.

The magnets 54 are preferably undercut front and rear to provide mounting recesses 62, 64 of size and configuration to tightly engage and secure about portions of the depending fingers 48 and the bent retainers 50 of the metallic keeper 38 as shown. A suitable adhesive or cement preferably can be applied at the mounting recesses 62, 64 to assure a substantially permanent bonding or interconnection between the magnets 54 and the bent retainers 50 under all normal conditions of use.

Figure 3:
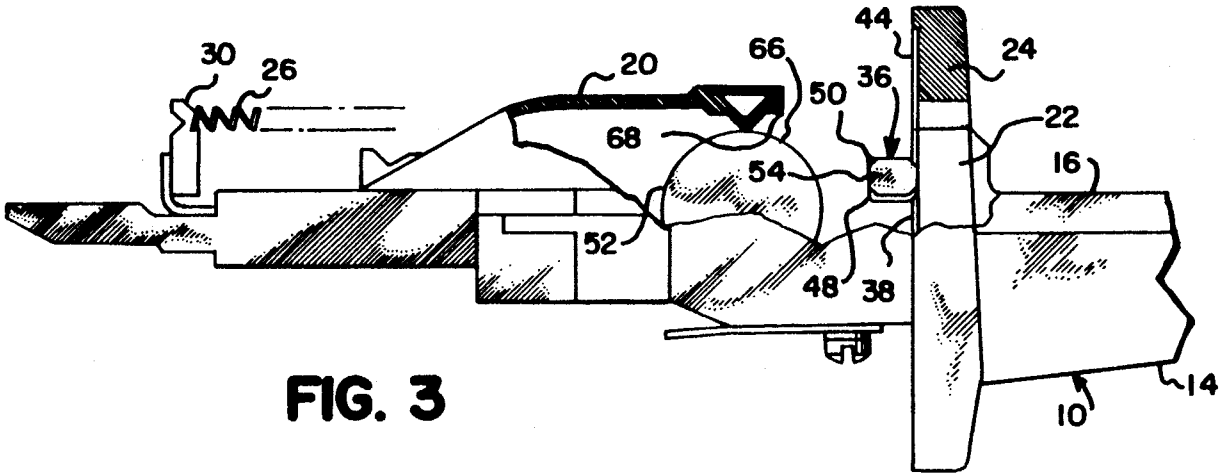
FIG. 3 is a side elevational view similar to FIG. 2 showing an authentic coin in passing relationship beneath the bridge.

As illustrated in FIG. 3, the bent retainers 50 are so configured and formed so as to position the magnets 54 at an elevation above the center of the coins 52 or any ferrous slugs 60 as they reside in the coin openings or slots 53. Accordingly, when a slug 60 is attempted to be utilized for vending purposes, the magnetic attraction of a magnet 54 will cause the slug 60 to rise out of its associated coin opening 53 to the elevated position 66 as shown in FIG. 2. Once the slug 60 has been raised to the elevated position 66 upon attraction by a magnet, further rearward urging of the slide plate 16 will cause a portion of the outer periphery of the slug 60 to contact and jam against the forward edge 68 of the bridge 20. This contact in turn will jam the mechanism and prevent any additional rearward movement of the slide 16. The magnetic attraction of the magnets 54 must be sufficiently great to retain the slug in the elevated position 66 and to absolutely prevent the slug from being worked below and through the bridge 20 in the manner of a normal, authentic coin upon manipulation of the handle and slide plate.

Accordingly, with very little additional parts and with only minor modification to an existing vertical type coin slide, an additional feature of magnetic slug attraction can be conveniently provided in a coin slide 10 whenever so required for any particular location. An existing coin slide can be readily treated to incorporate the magnetic slug attracting means of the present invention by simply equipping the existing coin slide construction with a modified bridge 20 of design to define the clearance space 34 and by installing a metallic keeper 38 rearwardly upon an existing slide mounting flange 24. These minor modifications will then support and position a plurality of small, extremely powerful magnets 54 in a suitable location to detect, attract and to lift ferrous slugs 60 from the slide plate 16 as the slide plate is rearwardly urged. The slugs will be elevated and maintained sufficiently elevated to jam the mechanism so that each slug 60 will stop against the forward edge 68 of the bridge 20 and will not be able to pass under the bridge in the manner of an authentic coin. Accordingly, upon the elevation of a slug by a magnet 54, the slide plate will become jammed and inoperative, thereby positively preventing operation of the coin slide 10.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. In a coin slide of the type having a body with an integral slide mounting flange adapted for mounting the coin slide upon a vending machine, the slide mounting flange being provided with a plurality of coin receiving grooves, a slide plate having a plurality of coin slots therein to receive coins in vertical orientation, the slide plate being movable relative to the body between a forward, coin receiving position and a rearward, vending position, the improvement comprising:

a keeper rearwardly secured to the slide mounting flange, the keeper having a rearward face and an upper body, the keeper having a plurality of spaced fingers depending from the upper body, the fingers having a generally J-shaped configuration;

a bridge secured to the body rearwardly of the slide mounting flange, the bridge terminating forwardly in a forward edge, the forward edge of the bridge and the rearward face of the keeper defining a clearance space therebetween;

magnet means secured to the keeper above the slide plate, comprising a plurality of discrete, powerful magnets, each respectively secured to one of the fingers, the magnets being positioned in the clearance space and being operable to attract and lift from an associated coin slot any ferrous slugs placed in the coin slot, the magnets defining a plurality of coin checking paths therebetween, the coin checking paths being sufficiently wide to pass coins and slugs therethrough.

2. The coin slide of claim 1 wherein the coin checking paths between the magnets respectively longitudinally align with the coin receiving grooves in the slide mounting flange.

3. The coin slide of claim 1 wherein each ferrous slug comprises a center of gravity and wherein the magnets are positioned in the clearance space above the center of gravity.

4. The coin slide of claim 1 wherein each magnet comprises a planar face.

5. The coin slide of claim 4 wherein a north or south magnetic pole coincides with each said face.

6. The coin slide of claim 5 wherein each said coin checking path is defined by two spaced sides and wherein each coin checking path side comprises a magnet face.

7. The coin slide of claim 4 wherein each magnet comprises a pair of transversely spaced, planar faces.

8. The coin slide of claim 7 wherein one of said planar faces comprises a north magnetic pole and the other said planar face comprises a south magnetic pole.

9. The coin slide of claim 8 wherein the magnets are mounted in side by side relationship with their respective opposed planar faces in parallel alignment.

10. The coin slide of claim 9 wherein the magnets are mounted so that the north magnetic face of one magnet faces the south magnetic face of the next adjacent magnet.

11. The coin slide of claim 1 wherein at least three edges of a magnet contact its associated finger.

12. The coin slide of claim 11 wherein the width of the bent fingers is narrower than the width of the magnets.

13. The coin slide of claim 12 wherein at least some of the magnets are undercut along one edge and wherein a portion of the associated bent finger is secured within the undercut area.

14. The coin slide of claim 1 wherein the number of magnets employed equal the number of coin slots in the slide plate plus one.

15. The coin slide of claim 1 wherein the magnets are so positioned that any attracted slug will be caused to contact the forward edge of the bridge as the slide plate is moved toward its said rearward, vending position.

16. The coin slide of claim 15 wherein each magnet is sufficiently powerful to prevent a slug from passing beneath the bridge after contacting the forward edge of the bridge.

* * * * *